US005845594A

United States Patent [19]

Hallsten et al.

[11] Patent Number: 5,845,594

[45] Date of Patent: Dec. 8, 1998

[54] DOCK STRUCTURE

[75] Inventors: John Hallsten, Sacramento; Roland C. Wright, Roseville; Jeffrey A. Hallsten, Scramento, all of Calif.

[73] Assignee: Hallsten Corporation, Sacramento, Calif.

[21] Appl. No.: 821,687

[22] Filed: Mar. 20, 1997

[51] Int. Cl.[6] ..... B63B 35/44

[52] U.S. Cl. ..... 114/263; 114/267

[58] Field of Search ..... 114/85, 263, 267; 405/218, 219

[56] References Cited

U.S. PATENT DOCUMENTS

| | | | |
|---|---|---|---|
| 3,073,274 | 1/1963 | Lamb | 405/219 |
| 4,078,515 | 3/1978 | Svirklys | 405/219 |
| 4,316,426 | 2/1982 | Meeusen | 405/219 |
| 4,352,597 | 10/1982 | Kay | 114/263 |
| 5,412,915 | 5/1995 | Johnson | 405/218 |

*Primary Examiner*—Ed L. Swinehart
*Attorney, Agent, or Firm*—Thomas M. Freiburger

[57] ABSTRACT

A floating dock preferably comprised of at least two elongated panels and derives its transverse load supporting strength from flotation tubs at the lower side of the dock. The deck portion of the dock is assembled from aluminum extrusions, preferably without welds. The dock assembly involves a minimum of parts and minimal assembly time. In typical sizes, e.g., about 6 feet in width and 20 to 40 feet in length, the dock units can be prefabricated at a plant and shipped by truck to the point of use.

10 Claims, 8 Drawing Sheets

DOCK STRUCTURE

BACKGROUND OF THE INVENTION

The invention relates to marine docks, and in particular to a dock structure of advantageous construction involving a minimum of components and allowing efficient factory prefabrication and quick field assembly.

Although many marine docks have been formed of wood, docks have often been formed of aluminum extrusions assembled together. For example, U.S. Pat. No. 5,050,361 of Hallsten Corporation shows a modular deck or dock structure in which the deck planks are arranged lengthwise. Cross members receive the ends of the planks and form panels which are interconnected to create the desired length of the dock structure. Thus, the panel framing members become structural supporting members in the assembled dock. In the '361 patent, a pair of spaced apart, elongated floats extend lengthwise, and the dock rests on the floats. The floats are relied on only for buoyancy, not for structural support.

In docks such as the '361 patent a structural fender is attached to the side of the docks, to add rigidity and to support a flexible bumper for boats. Thus, in a typical such construction two separate components are required at each side edge of the dock, in addition to the deck structure itself. The fender is typically made of wood whereas the bumper is often a hollow vinyl extrusion.

Assembly time is extremely important in dock construction and is a major consideration in docks assembled of aluminum components. The greater extent of the dock system can be prefabricated in a plant, and the less field assembly required, the more cost effective is the project. It is an object of the invention to provide a dock structure in which the great majority of the fabrication steps can be done in a factory, with prefabricated panels then taken to the site and put together in a minimum of time.

SUMMARY OF THE INVENTION

In dock structures according to the present invention, a dock is made up of one or preferably a plurality of interconnected panels supported by flotation tubs. In a preferred embodiment, the dock comprises two panels, each panel being made up of a multiplicity of parallel, edge-to-edge transverse deck slats supported at ends by longitudinal framing members. The longitudinal framing members extend through the length of the dock and each has a channel receiving the ends of the transverse deck planks, which are supported solely at their ends. This forms a deck structure, which is supported beneath by at least one flotation unit positioned to stably support the deck planks and framing members by contact with the framing members.

Means are provided for securing the longitudinal framing members to a top deck of the flotation unit, thus serving as a means for preventing separation of the longitudinal framing members from the deck planks. A combined fender/bumper extends longitudinally at each of the two opposed outer sides of the dock, each fender/bumper being secured to a respective longitudinal framing member and having a height sufficient to cover the side of the longitudinal framing member. In a preferred embodiment this fender/bumper has a height sufficient to cover the side of the extruded metal longitudinal framing member, and has sufficient strength to add rigidity to the edge of the dock, while being sufficiently flexible to receive repeated bumping impact from boats without damage to boats or to the dock. In preferred embodiments the fender/bumper member comprises a relatively heavy, hollow vinyl or elastomeric extrusion, serving functions of a wooden edge fender and a flexible bumper for contact with boats.

In a preferred embodiment a plurality of the elongated panels are secured side-by-side to form the dock. In this case, the longitudinal framing member between the two panels comprises two separate aluminum extrusions, each having a channel-shaped opening for receiving respective deck planks of the respective panel. The two extrusions are secured together preferably without fasteners or welds, using an interlocking flange structure somewhat similar to that disclosed in the above-referenced patent, with a flexible slidingly assembled between the two interlocking aluminum extrusions to retain them locked to one another without fasteners. One of these extrusions is a utility side member having a tall cross section matching that of the longitudinal framing members at outer sides of the dock structure, while the other is of shorter cross section, basically the height of the deck-receiving channel. At outer edges of the dock structure, the same utility side members are used as the longitudinal framing members, with provision to interlock with the fender/bumper at each side of the dock.

The panels of the dock structure rests via the longitudinal framing members against the top deck of one or more flotation units below. Since the multi-panel dock embodiment has no supportive structural strength from side to side, i.e., no structural cross member supporting the two (or more) panels from sagging or failing in the middle, the support of the panels on the flotation units serves to provide such structural supporting strength. In preferred embodiments a plurality of flotation units are positioned in series beneath the panels of the dock, with the flotation units spaced apart and each extending essentially through the width of the dock. The longitudinal framing members preferably are bolted down to the deck of each flotation unit, at edges and corners. For this purpose, each longitudinal framing member includes a generally horizontal foot portion at its lower end, through which bolts engage.

In a preferred embodiment, the horizontal foot portion of the framing members comprises an open-bottomed channel with inwardly hooked edges, and the outer two of these longitudinal framing members are engaged via their foot portions with a complementarily shaped, flanged bracket on a structural bordering frame around the top deck of the flotation units below. The framing member foot portions may be assembled to these flanged brackets by sliding, such assembly preventing lateral movement of the panels relative to the flotation units and also upward movement of the panels. With such a connection between the panels and flotation units, the bolts or other fasteners between the flotation unit deck and the framing member foot portions primarily serves only to prevent longitudinal relative movement.

In a preferred embodiment end structures are provided extending across the width of the dock, attached to each short end of the dock structure. The end structure abuts the unitary elastomeric fender/bumper extrusions and retains them from sliding movement relative to the framing members.

Accordingly, it is among the objects of the invention to improve marine dock structures by reducing the number of assembled components and by providing for a majority of construction as factory prefabrication, with minimal assembly steps required on site. This is accomplished in part by the arrangement of prefabricated panels in the dock and also by use of the flotation tubs as structural members in preferred embodiments. These and other objects, advantages and features of the invention will be apparent from the following description of preferred embodiments, considered along with the accompanying drawings.

DESCRIPTION OF PREFERRED EMBODIMENTS

Figure 1:
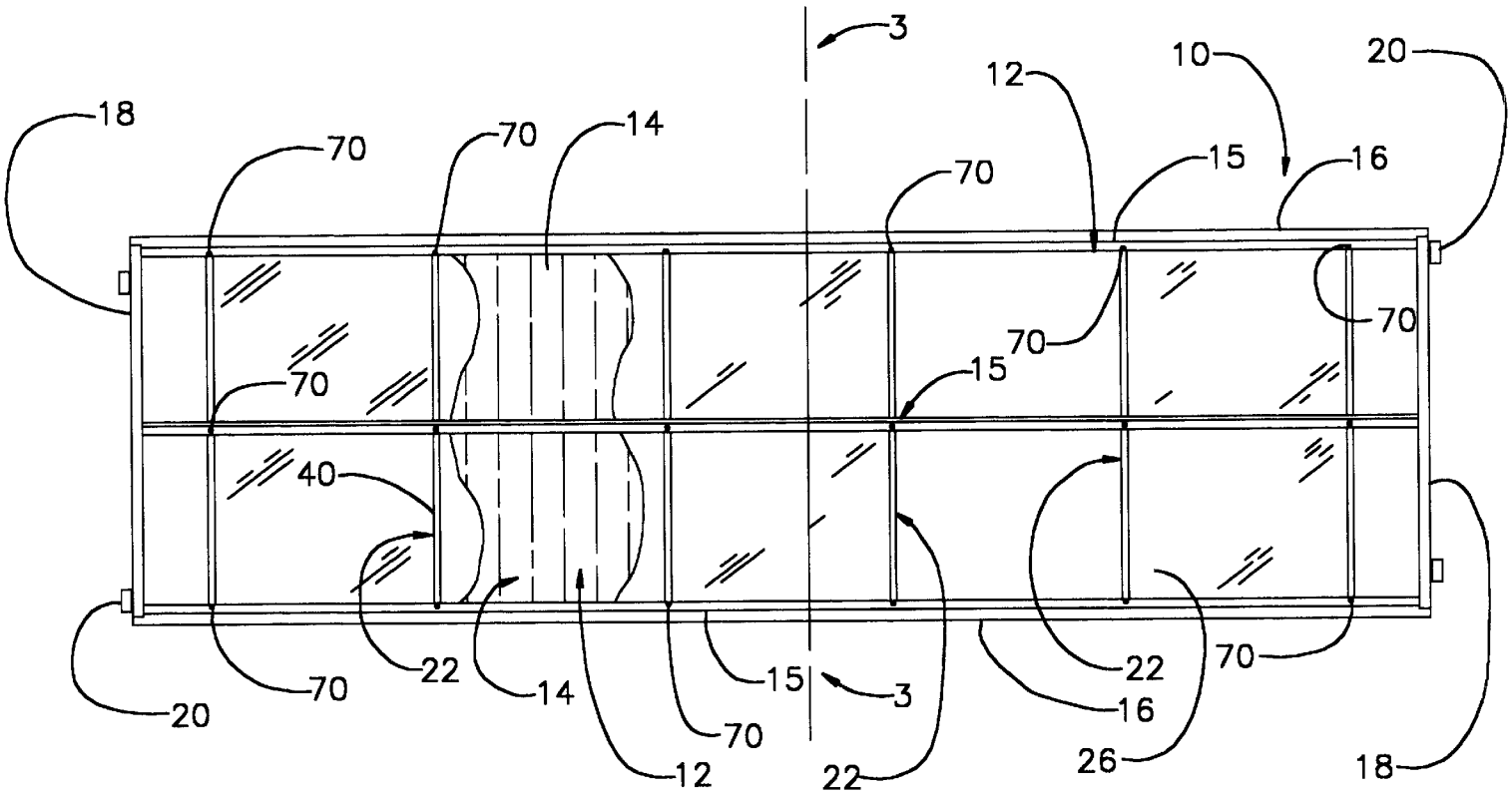
FIG. 1 is a plan view, partly broken away, showing a modular floating dock structure of the invention, including two modules or panels.

In the drawings, FIG. 1 shows in plan view a dock structure 10 constructed in accordance with the principles of the invention. The assembled dock 10 is made up of two elongated panels or modules 12, although a dock of the invention could be fabricated with only a single such module. Each panel 12 extends longitudinally (left to right in FIG. 1), preferably through the length of the dock as shown. The panels are advantageously prefabricated in a factory, each comprising a multiplicity of parallel, transverse edge-to-edge deck slats 14 held at their ends by a longitudinal framing member 15, into which the deck slats 14 are received. The prefabrication can include the entire dock (or virtually the entire dock). A common width for the dock is about six feet, with length about 20 feet, up to about 40 feet, for shipment on a truck.

The deck slats 14 preferably are interconnected at edges in the manner shown in U.S. Pat. No. 5,617,677, incorporated herein by reference.

As also seen in FIG. 1, the dock 10 has a combined bumper/fender 16 at each side, secured to the longitudinal framing member 15. This bumper/fender 16, discussed further below with reference to FIGS. 4 and 5, serves to some extent as a structural member (replacing the usual wooden member) and primarily as both a fender and a bumper for boats approaching or tied to the dock. At ends of the dock 10 are end member structures 18, each extending transversely and preferably secured to the exterior longitudinal framing members 15 as explained further below. FIG. 1 shows an example in which the dock 10 has hinge sections 18 as the end structure, with cylindrical sleeves 20, for pinned connection to similar sleeves of an adjacent dock or other attachment.

As also indicated in FIG. 1, the panels 12 of the dock 10 are supported by at least one flotation unit below. In the embodiment shown, three separate, spaced apart flotation units 22 are arranged in series, each extending essentially through the entire transverse width of the dock. It is an important feature of the invention that these transversely extending flotation units act as part of the structure to support the panels 12 in carrying the weight of these panels and loads placed upon the dock. Thus, the panels themselves (when formed of two or more modules 12) include no transverse load-supporting structural members extending transversely through the width of the dock, and instead, the panels rest on the flotation units 22, which provide structural strength against sagging or flexure between the two lateral sides of the dock (top and bottom as viewed in FIG. 1). These flotation units 22 also provide structure holding the width of the dock together, maintaining the deck slats 14 in the framing members 15, even if the dock is the width of a single module 12.

Figure 6:
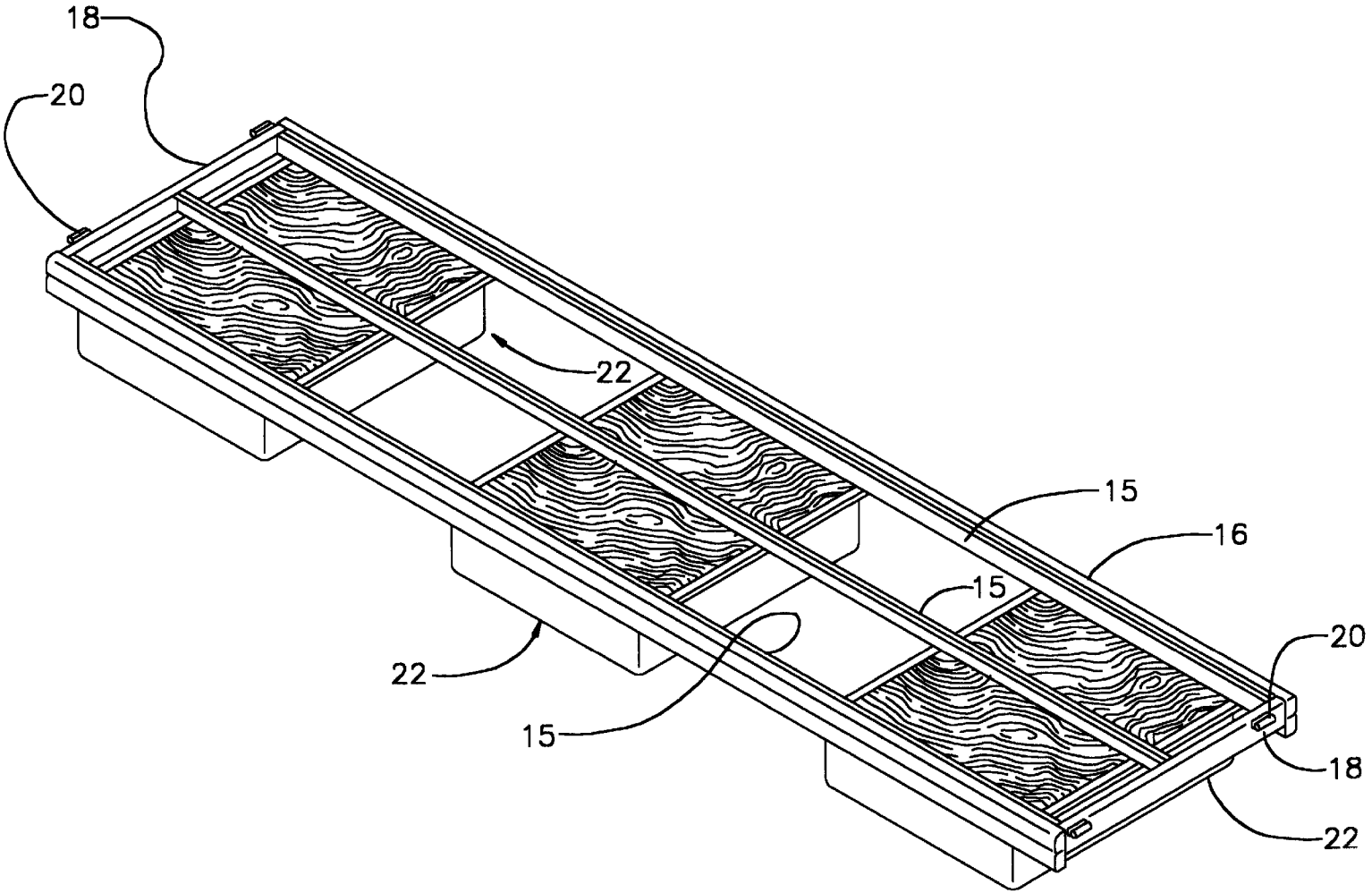
FIG. 6 is a perspective view showing the floating dock structure of FIGS. 1–3, but with the deck panels not shown for clarity.

FIG. 6 shows the dock in perspective, with deck slats 14 removed for clarity.

Figure 2:
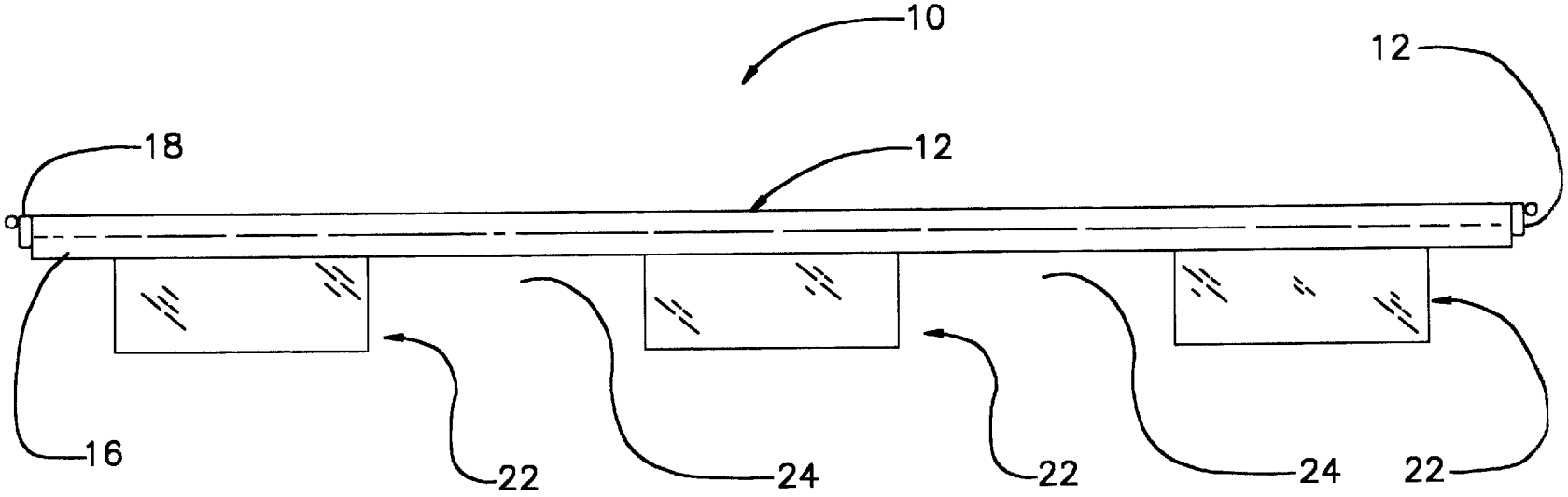
FIG. 2 is a side elevation view of the same floating dock structure.

FIG. 2 shows the flotation units 22 as supporting the panels 12, in side elevation view. As shown, the floats 22 may have considerable spaces 24 between them, and those spaces may be slightly larger than the width (in the longitudinal direction of the dock, left to right in the figure) of the floats. This is possible because the longitudinal framing members 15 (not specifically visible in FIG. 2) provide longitudinal structural strength, capable of spanning between the floats 22 across the spaces 24.

Figure 3:
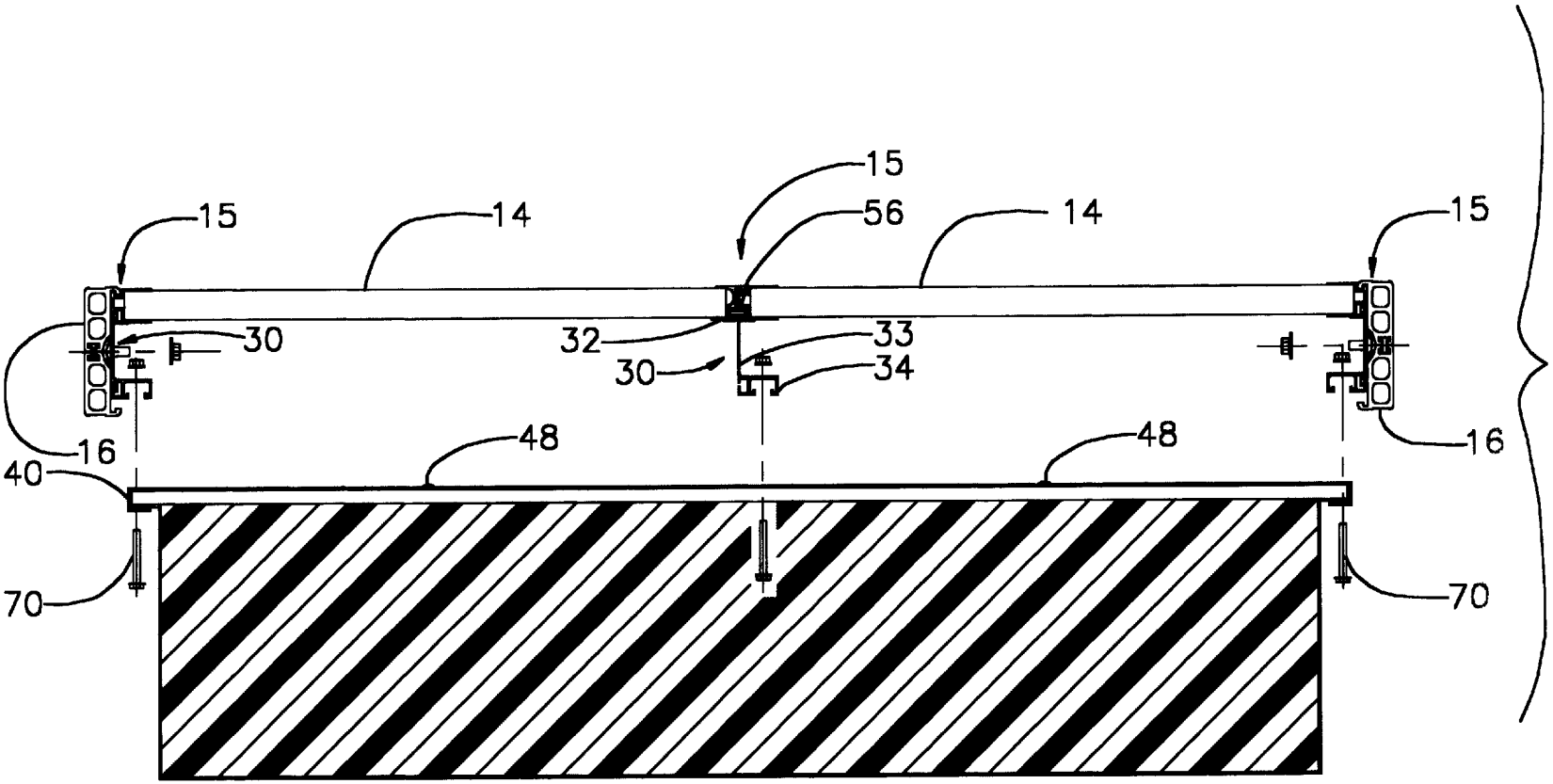
FIG. 3 is an exploded transverse cross sectional view of the dock, as generally seen along the line 3—3 in FIG. 1.
Figure 3A:
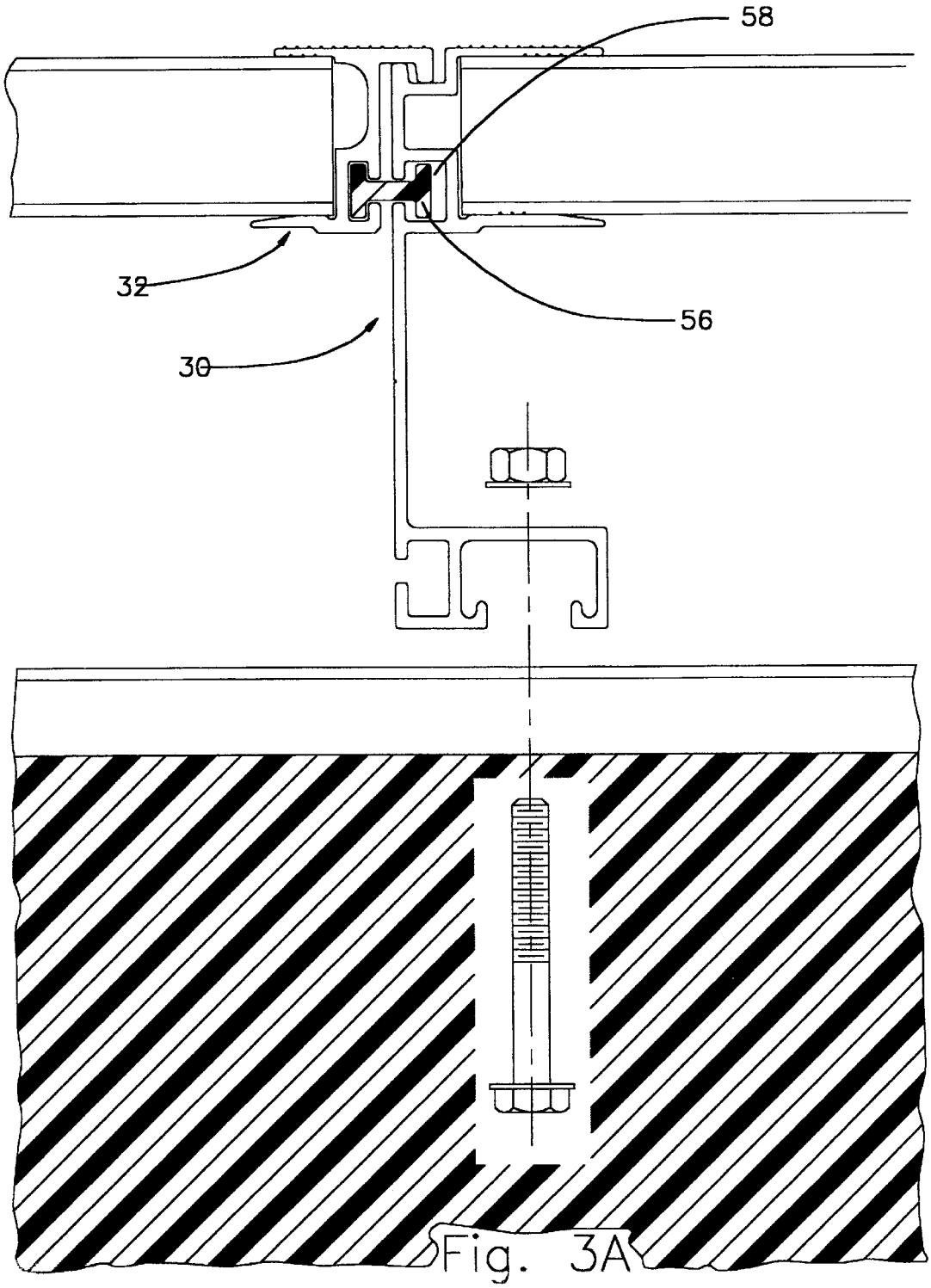
FIG. 3A is an enlarged exploded view in elevation, showing a portion of the cross sectional view in FIG. 3.
Figure 4:
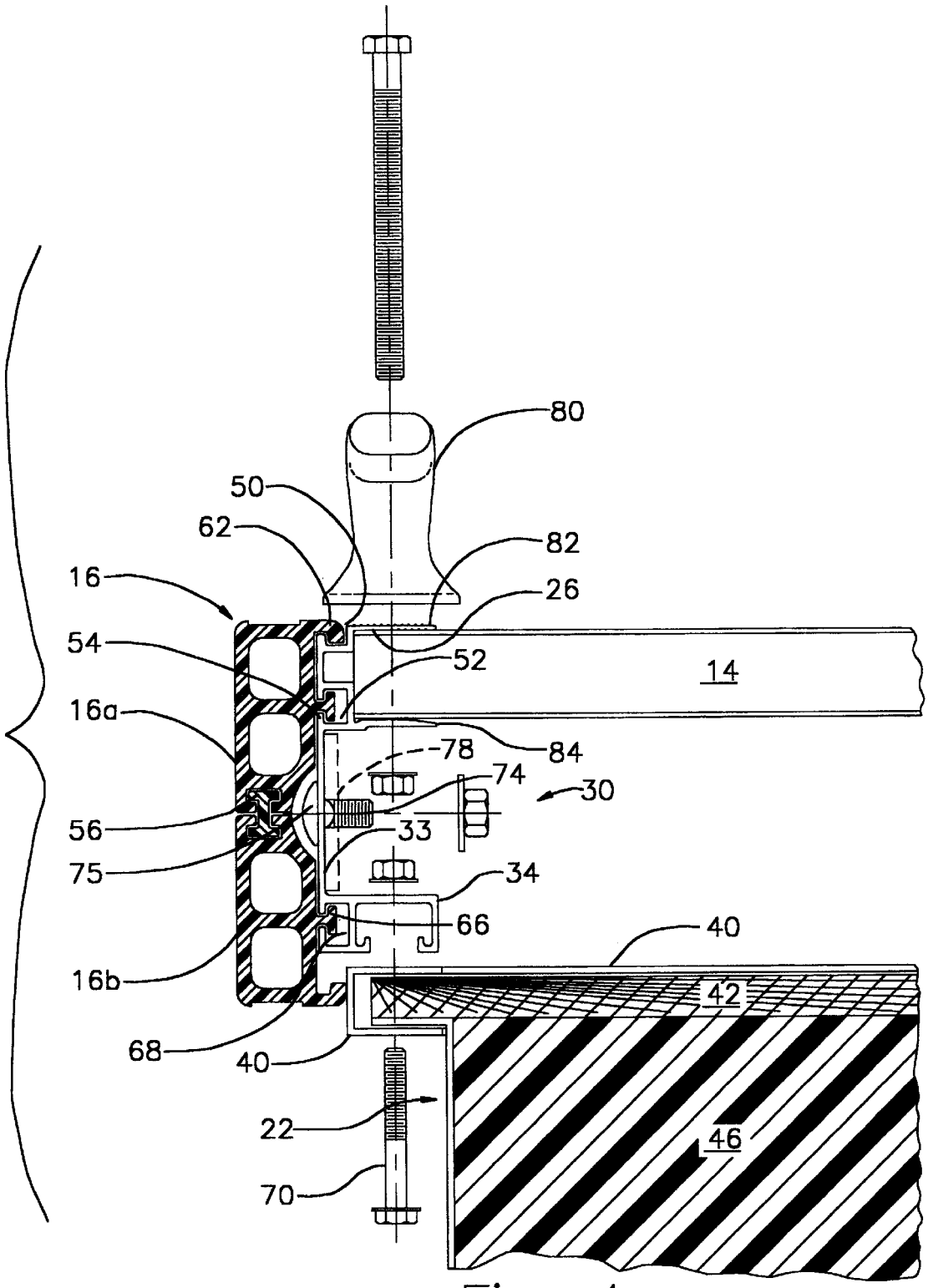
FIG. 4 is an enlarged detail view in transverse section showing a preferred interconnection between a deck portion and a flotation tub of the dock structure.

The cross sectional views of FIGS. 3 and 3A reveal the deck slats 14 as retained in the longitudinal framing members 15, by slat receiving channels 26 in each longitudinal framing member, better seen in the detail view of FIG. 4. The entire assembly preferably is held together widthwise by connection to the floats 22 below, but also to some extent by the end member structures 18 at ends, explained further below.

Figure 5:
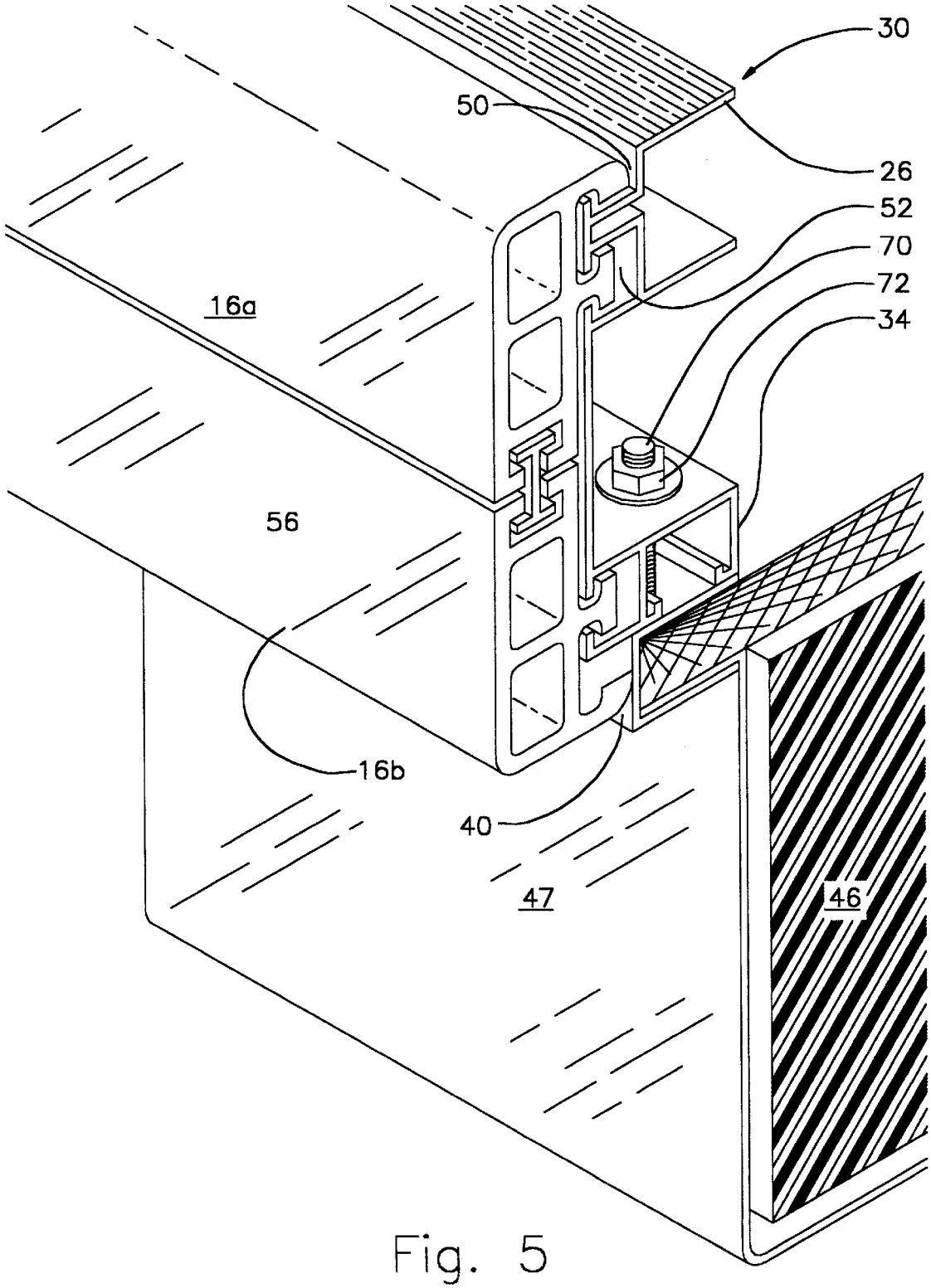
FIG. 5 is a perspective view showing the interconnection detailed in FIG. 4, with some parts removed for clarity.

FIGS. 3 and 3A show that the intermediate longitudinal framing member 15 (of which there may be more than one, if more than two panels are included) differs from the outer two framing members 15 in being formed of two components. The central or intermediate longitudinal framing member includes a utility side member 30 secured to an interlocking deck channel 32, whereas each of the outer framing members 15 comprises simply a utility side member 30. In a variation of the invention, the central longitudinal framing member may be formed of a single extrusion. The utility side members 30 each have a deck plank receiving channel 26, as indicated in FIGS. 3 and 4, as well as a vertical web 33 and a generally horizontal foot portion 34. FIG. 4 shows the cross section of the utility side member 30 in greater detail, and FIG. 5 shows this structure in perspective. It is seen that the foot portion 34, in a preferred embodiment, is an open-bottomed C-shaped member. This cross section is designed to rest on a structural edge channel 40 extending around the perimeter of a top deck portion 42 of each of the flotation units 22.

The top deck 42 of each flotation unit 22 includes a rigid deck membrane 44, which may be, for example, ¾ inch CDX plywood. Flotation material 46 beneath the plywood 44 may comprise polystyrene foam with minimum density of about 1.0 lb. per cubic foot, contained within a tub 47 preferably of ⅛ inch thick linear low density polyethylene.

As can be seen from FIGS. 1, 3 and 4, the structural edge channel 40 wraps around the entire periphery of the flotation unit's deck 42, and may be bolted down to the deck at spaced locations with carriage bolts such as shown at 48 in FIG. 3. Structural edge channels 40 are shown in FIG. 1 and FIG. 4 extending in the transverse direction. These need not be secured to the longitudinal edge channels 40 at corners, but are secured to the plywood deck membrane 44 and provide structure to retain the deck assembly together widthwise.

FIG. 3 shows the interlocking connection between the utility side member 30 and the interlocking deck channel 32, in the middle longitudinal framing member 15. The detailed views of FIGS. 4 and 5 better show some of the structural features of the utility side member 30, even though in FIGS. 4 and 5 that member is not connected to an interlocking deck channel. Each utility side member 30 has a longitudinal slot 50 at its upper edge as seen in FIG. 4, with a C-shaped channel 52 also formed in the extrusion and located somewhat below the upper slot 50. The C-shaped channel 52, open only at a side slot 54, is designed to receive an elongated flexible protrusion, in a sliding connection. In the case of connection with the interlocking deck channel 32 as shown in FIG. 3, the deck channel 32 has a similar C-shaped opening, and the two openings are abutted in facing relationship for the connection. An upper hook flange 54 of the deck channel 32 sits in the slot or groove 50 of the utility side member, and a flexible, preferably elastomeric H-shaped panel splice member 56 is pushed into place, bridging between the two C-shaped channels, to lock the two extrusions 30 and 32 together. As better seen in FIG. 3A, the H-shaped panel splice member 56, which may be formed of the material Elvax, has the outer flanges of the H occupying most of the space in each of the two C-shaped channels, while a bridging web 58 of the H-shaped member 56 bridges between the two extruded sections. Similar connections are also shown in U.S. Pat. No. 5,325,646 and application Ser. No. 270,010 filed Jul. 1, 1994, both of the assignee of this invention. The illustrated interlocking connection is efficiently made in the field, avoiding welds, rivets or bolts, and can save considerable erection time in a dock. However, a dock section of about 6 foot width and 20 foot length usually can be fully assembled at a plant and trucked to a site.

FIGS. 4 and 5 show that the same slot or groove 50 and C-shaped channel 52 of the utility side member 30 is used to receive a combination fender and bumper 16 at each of the two opposed sides of the dock. The fender/bumper 16 is of a flexible, preferably elastomeric material and may comprise a hollow extrusion as shown, for receiving repeated bumping from boats, avoiding damage to both boats and dock. The material designated No. 52-623 by Fabricated Extrusions Company of Modesto, Calif. may be used. At the same time, this elongated member 16, which preferably is uninterrupted for the length of the dock 10, adds some structural rigidity to the edges of the dock, but primarily acts as a fender for withstanding impact of large blows to the dock, and a bumper to protect docked boats from nicks. Prior docks of this general size for small boats typically had a wooden fender and a separate vinyl bumper strip. FIG. 4 shows that the elastomeric or vinyl fender/bumper 16 has an upper hooked flange 62 which engages slidingly in the upward facing slot or groove 50 of the metal extrusion; a barb-shaped protrusion 64 which is slidingly received in the open C-shaped channel 52 of the metal extrusion; and a similar, lower barb-shaped protrusion 66 which is received in a lower and similarly configured C-shaped channel 68 of the metal extrusion. FIG. 5 shows that the fender/bumper 16 may be formed of separate upper and lower sections 16*a* and 16*b*, connected by an H-shaped splice member 56. The two-piece structure reduces required extruding die size and can make the sliding assembly of the fender/bumper to the utility side member 30 easier.

FIGS. 4 and 5 indicate that through bolts 70 preferably are used to secure the utility side members 30 in place on the structural edge channels 40 of the top deck of the flotation tubs 22. The bolt 70 and nut 72 are provided to lock the components against lateral and longitudinal movement. FIG. 1 shows that these bolted connections may be made at corners of the flotation units and at intermediate locations where the middle longitudinal framing member 15 crosses the structural edge channels 40 of the flotation unit decks. These locations are indicated at 70 in FIG. 1.

Figure 7:
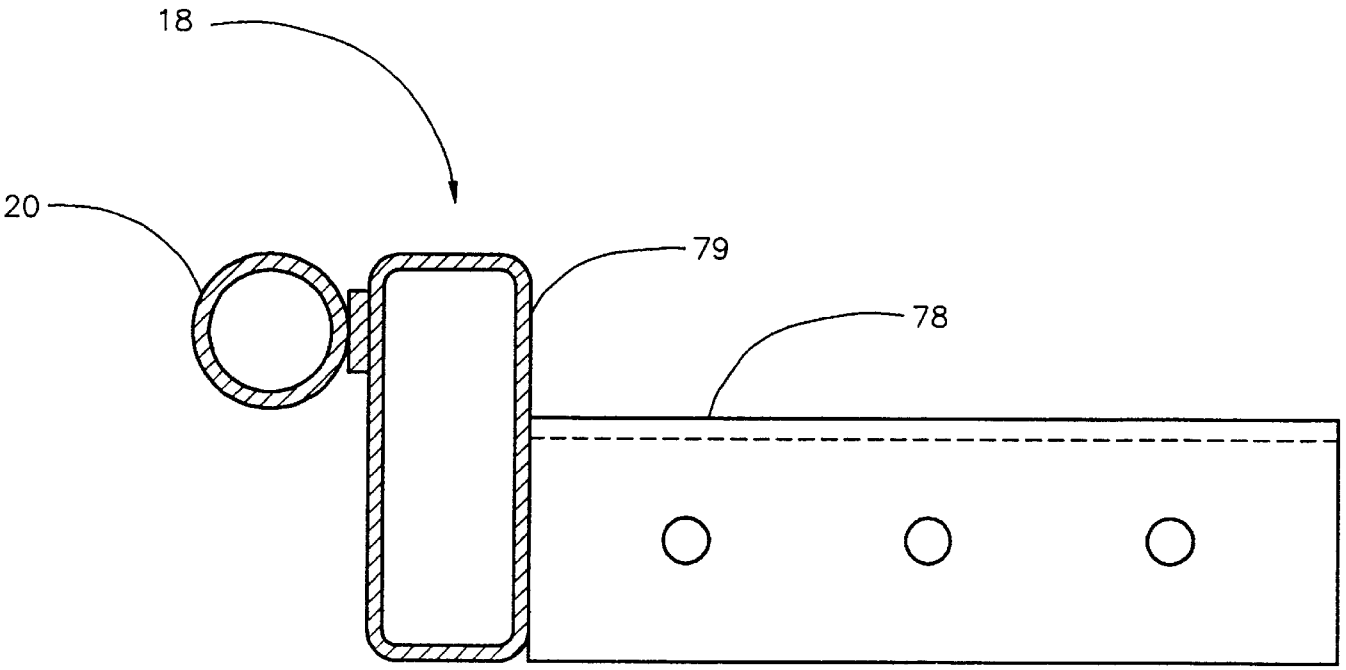
FIG. 7 is a sectional view showing a dock end member to be secured to the dock structure, also seen in FIGS. 1 and 2.

As also seen in FIG. 4, bolts 74 may extend transversely through the edge longitudinal framing members, with heads 75 positioned behind the slidingly-fitted fender/bumper extrusion 16. Such bolts can be used at the longitudinal ends of the dock, for connection to the end member structure 18 shown in FIG. 1 and detailed in FIG. 7. FIG. 4 shows in dashed lines a flange 78 extending into the longitudinal framing member 30, from one of the end structures 18, and this connecting flange 78 is seen in FIG. 7, secured to a tubular transverse structural bar 79.

The end member 18 preferably is assembled onto the side member 30 before the vinyl fender/bumpers 16 are assembled, and also before connection to the flotation tubs, to provide access to install the bolts 74.

FIG. 4 also shows an example of a connection of a mooring cleat 80 to the top of the dock, near an edge of the dock. The cleat 80 may be bolted through a top flange 82 of the channel 26 formed in the longitudinal framing member, and through a deck plank 14 and then through the bottom flange 84 of the longitudinal framing member channel 26. Such bolted connections are preferably made prior to assembly to the flotation tubs 22, since some of the mooring cleats might occur adjacent to a flotation tub location, making access from below difficult. Alternatively, the cleats may be secured with long bolts going down through the entire utility side member 30 and through the channel 40 on the tub; or cleats may be welded onto the top of the flange 82.

The dock assembly of the invention produces a high integrity dock involving a minimum of parts, minimum of fasteners and minimal assembly time, typically about one-half the time required for a conventional dock structure which this dock would replace. At the same time, cost of components is minimized by avoiding the need for any load supporting structural members through the width of a multiple-panel dock. This is achieved by use of the deck frame of the flotation units below, to serve as unitizing structural components for the deck structure above. The use of lumber at the edge of the dock is avoided, by the use of a vinyl edge extrusion which serves as both a fender and a bumper. In addition, welds are avoided, which is important in the marine environment, through use of aluminum extrusions interconnected in the manner described above.

The above described preferred embodiments are intended to illustrate the principles of the present invention, but not to limit the scope of the invention. Other embodiments and variations to these preferred embodiments will be apparent to those skilled in the art and may be made without departing from the scope of the invention as defined in the following claims.

We claim:

1. A dock for flotation on water, having a longitudinal direction and a transverse direction and comprising:

at least one panel extending longitudinally through the length of the dock, each panel including a multiplicity of deck planks each extending transversely and side by side in the dock structure, the deck planks having means for interconnection with one another at edges, a longitudinal framing member at each side of the panel, each framing member having a channel receiving the ends of deck planks, the deck planks being solely supported at their ends and said ends being secured into the channels of the framing members without welds, at least one flotation unit beneath the panel or panels, with a top deck of the flotation unit positioned to stably support the deck planks and framing members by contact with and securement to the framing members, there being no other transverse load-supporting structural members extending transversely through the width of the dock, securing means for securing the longitudinal framing members to the top deck of the flotation unit, serving as means for preventing separation of the longitudinal framing members from the deck planks, and a combined fender and bumper extending longitudinally at opposed outer sides of the dock, each fender/bumper being alongside and secured to a longitudinal framing member and having a height sufficient to cover the side of the longitudinal framing member, the fender/bumper having strength sufficient to add rigidity to the edge of the dock and being sufficiently flexible to receive repeated bumping impact from boats without damage to the boats or the dock.

2. A dock according to claim 1, wherein a plurality of said flotation units are included, each extending through the width of the dock and the flotation units being arranged in series in the longitudinal direction of the dock, with space between successive flotation units.

3. A dock according to claim 1, wherein the top deck of the flotation unit includes a metal frame extending around an entire periphery of the top deck, and wherein the longitudinal frame members each include a generally horizontal foot portion spaced below the deck planks, the foot portion being secured by fasteners to the metal frame around the top deck of the flotation unit.

4. A dock structure according to claim 1, including at least two of said panels side by side and defining the width of the dock, one said longitudinal framing member being positioned along a junction of the two side by side panels and being comprised of (1) a utility side member extending full height from the top of the deck planks down to the top of the flotation unit and having a channel receiving ends of the deck planks of one panel, and (2) an interlocking deck channel secured to the utility side member and having a height only slightly greater than the deck planks and having a deck plank receiving channel extending toward the other of the two panels and receiving the ends of the deck planks from said other panel.

5. A dock according to claim 4, including interlocking means for securing the utility side member to the interlocking deck channel without welds or transverse fasteners.

6. A dock according to claim 5, wherein the interlocking means comprises hooked flanges on facing sides of the utility side member and the interlocking deck channel, positioned to prevent lateral separating movement and vertical relative shifting of the side member and the deck channel in one vertical direction, and the side member and deck channel each having facing C-shaped channels, and including flexible elongated panel splice extrusion, H-shaped in cross section, assembled by longitudinal sliding to engage in the two facing C-shaped channels, one side of the H-shaped extrusion in each C-shaped channel, to hold the side member and deck channel together.

7. A dock according to claim 1, wherein the combined fender and bumper comprises a hollow vinyl extrusion.

8. A dock according to claim 1 wherein the combined fender and bumper comprises a hollow elastomeric extrusion.

9. A dock according to claim 1, wherein the longitudinal framing member alongside the combined fender and bumper includes channel means for slidingly receiving protrusions of the combined fender and bumper so as to lock the fender and bumper in position against outwardly lateral, up or down movement.

10. A dock according to claim 1, wherein the longitudinal framing members each have a generally horizontal foot portion spaced below the deck planks and wherein the foot portions of the longitudinal frame members are bolted down to a top deck of the flotation unit at corners of the flotation unit.

* * * * *